US005555907A

United States Patent [19]

Philipp

[11] Patent Number: 5,555,907

[45] Date of Patent: Sep. 17, 1996

[54] DIVIDED BOX FOR VALVE CONTROLLER

[76] Inventor: Harald Philipp, 4812 Scott Rd., Lutz, Fla. 33549

[21] Appl. No.: 458,429

[22] Filed: Jun. 2, 1995

[51] Int. Cl.[6] ..... A47B 77/06; F16K 51/00

[52] U.S. Cl. ..... 137/312; 4/251.1; 4/630; 137/360; 137/382; 312/223.1; 312/229

[58] Field of Search ..... 137/312, 356, 137/357, 359, 360, 364, 377, 381, 382; 4/670, 251.1, 630; 312/223.1, 229

[56] References Cited

U.S. PATENT DOCUMENTS

| | | | |
|---|---|---|---|
| 1,690,461 | 11/1928 | Sieben | 137/382 |
| 3,031,871 | 5/1962 | Bailey | 137/360 |
| 3,096,782 | 7/1963 | Williams | 137/360 |
| 3,148,698 | 9/1964 | Arnold | 137/360 |
| 3,428,073 | 2/1969 | Krueger | 137/312 |
| 3,623,166 | 11/1971 | Wilkinson | 4/670 |
| 3,818,874 | 6/1974 | Tria | 137/312 |
| 3,862,433 | 1/1975 | Rousselet | 137/360 |
| 3,996,959 | 12/1976 | Caruth | 137/360 |
| 4,069,837 | 1/1978 | Jirasek | 137/360 |
| 4,167,196 | 9/1979 | Morris | 137/360 |
| 4,313,457 | 2/1982 | Cliff | 137/312 |
| 4,410,004 | 10/1983 | Kifer et al. | 137/360 |
| 4,450,855 | 5/1984 | Hills | 137/312 |
| 4,942,896 | 7/1990 | Slusser | 137/360 |
| 5,253,670 | 10/1993 | Perrott | 137/360 |

FOREIGN PATENT DOCUMENTS 2525652A 10/1983 France .

*Primary Examiner*—George L. Walton
*Attorney, Agent, or Firm*—David Kiewit

[57] ABSTRACT

An enclosure containing valves, batteries and electronic circuitry controlling the operation of an automatically actuated faucet includes a dividing wall slanted from the horizontal and separating an upper compartment, containing the valves, from a lower compartment containing the control electronics. Water from leaks in the top compartment (or water that runs down a pipe into the top of the box) runs down the slanted dividing shelf and drains from the box without contacting the electronic components. All the associated plumbing fittings are adjacent a top surface of the box so as to ease installation of the controller.

6 Claims, 3 Drawing Sheets

DIVIDED BOX FOR VALVE CONTROLLER

BACKGROUND OF THE INVENTION

The present invention relates to the field of automatic valve controls for faucets installed in restroom sinks and the like.

It is well known to enclose electrical splices, switches and other such equipment in protective boxes. When electrical controls are employed with plumbing components, it is also well known to seal the electrical components in separate housings, both to protect the electrical equipment from damage due to the intrusion of water and to preclude an electrical shock hazard.

The art of housing both plumbing and electrical equipment in a common enclosure is taught, inter alia, by:

Williams, in U.S. Pat. No. 3,096,782, who teaches a water tap and drain receptacle including an electrical junction box. Williams' inlet plumbing is above the electrical outlets and has a drain at the bottom of the enclosure to carry away water leaks. The bottom of Williams' receptacle serves to separate an unsealed electrical junction box from the piping above it.

Mezanguel, in FR 2,525,952, teaches a prefabricated bathroom assembly in which various plumbing fixtures are operated with low-voltage solenoid valves. His water inlet pipes or tubes are at the bottom and his low voltage wires run across the top of a prefabricated assembly.

Wilkinson, in U.S. Pat. No. 3,623,166, discloses a junction box including several solenoid valves. Wilkinson brings external wires into one side of his box and carries them into an upper portion of the box to operate a solenoid. Wilkinson does not segregate plumbing fixtures from electric wiring.

Hills, in U.S. Pat. No. 4,450,855, teaches apparatus for draining condensate from beneath the tank of a water tower and to thereby prevent water from dripping into occupied areas.

SUMMARY OF THE INVENTION

An enclosure containing valves, batteries and electronic circuitry controlling the operation of an automatically actuated faucet includes a dividing wall slanted from the horizontal and separating an upper compartment, containing the valves, from a lower compartment containing the control electronics. Water from leaks in the top compartment (or water that runs down a pipe into the top of the box) runs down the slanted dividing shelf and drains from the box without contacting the electronic components.

It is an object of the invention to provide a controller enclosure for automatic valves used with a wash receptacle, the enclosure having all the associated plumbing fittings adjacent a top surface to ease installation of the controller.

It is a further object of the invention to provide a controller enclosure that may be opened for routine service (e.g., for periodic battery replacement) without thereby accidentally allowing extraneous water in an upper portion of the enclosure from running into a lower portion of the enclosure and damaging electronic components.

DETAILED DESCRIPTION

Figure 1:
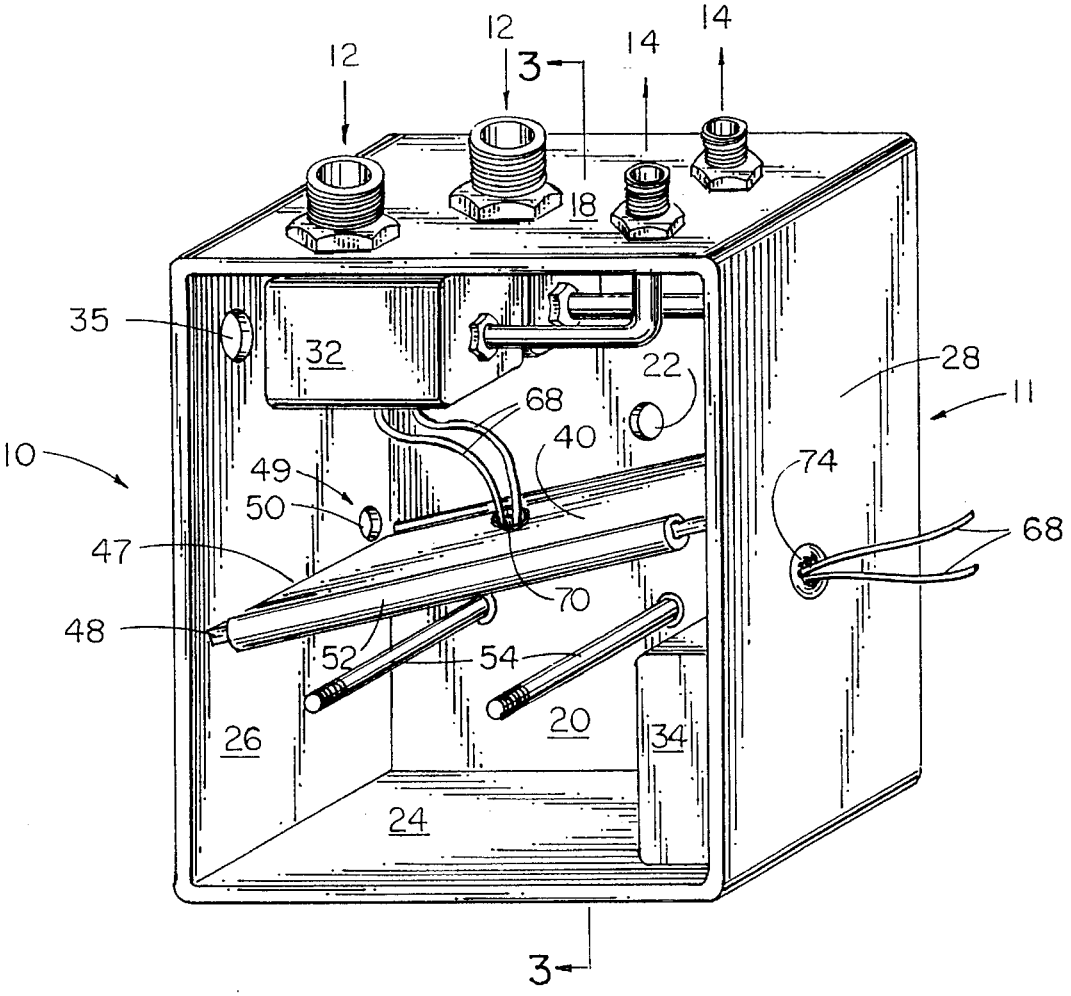
FIG. 1 of the drawing is an elevational view of a controller enclosure of the invention.

It is established practice to install the electronic control circuitry and the electrically operated valves for automatic faucets in a box or enclosure to prevent accidental damage and tampering. A designer of electrical equipment, on being asked to lay out such an enclosure, would place all the electrical components above the valves so that water leaks would not result in water dripping down onto the electronics. The installers of such enclosures, on the other hand, prefer all the plumbing fittings to be at or near the top of the enclosure so the enclosure can be installed near the floor of an under-sink cabinet or the like.

A preferred enclosure 10 providing the desired ease of installation by having water inlet 12 and outlet 14 lines and fittings 16 adjacent the top wall 18 of the enclosure 10 is shown in the drawing. This enclosure 10 comprises a box 11 having five exterior walls comprising a generally vertical back wall 20 (which may have throughholes 22 therein that can be used with screws, nails or other known fasteners (not shown) to attach the enclosure to a building wall), a generally horizonal bottom wall 24, a top wall 18, and two generally vertical side walls 26, 28. A lid 30 of the enclosure 10 is removable to allow access to the mounting holes 22 and for installation and replacement of various components, such as the solenoid valves 32 or a battery 34. Although the box 11 may be used with valves 32 having the inlet 12 and outlet 14 pipes or tubes plumbed through holes 35 the top 18 of the box 11, some varieties of valves 32 are more compatible with a design working one of the lines 12, 14 into the box 11 via throughholes 35 in the side 26 of the box adjacent the top surface 18.

Figure 2:
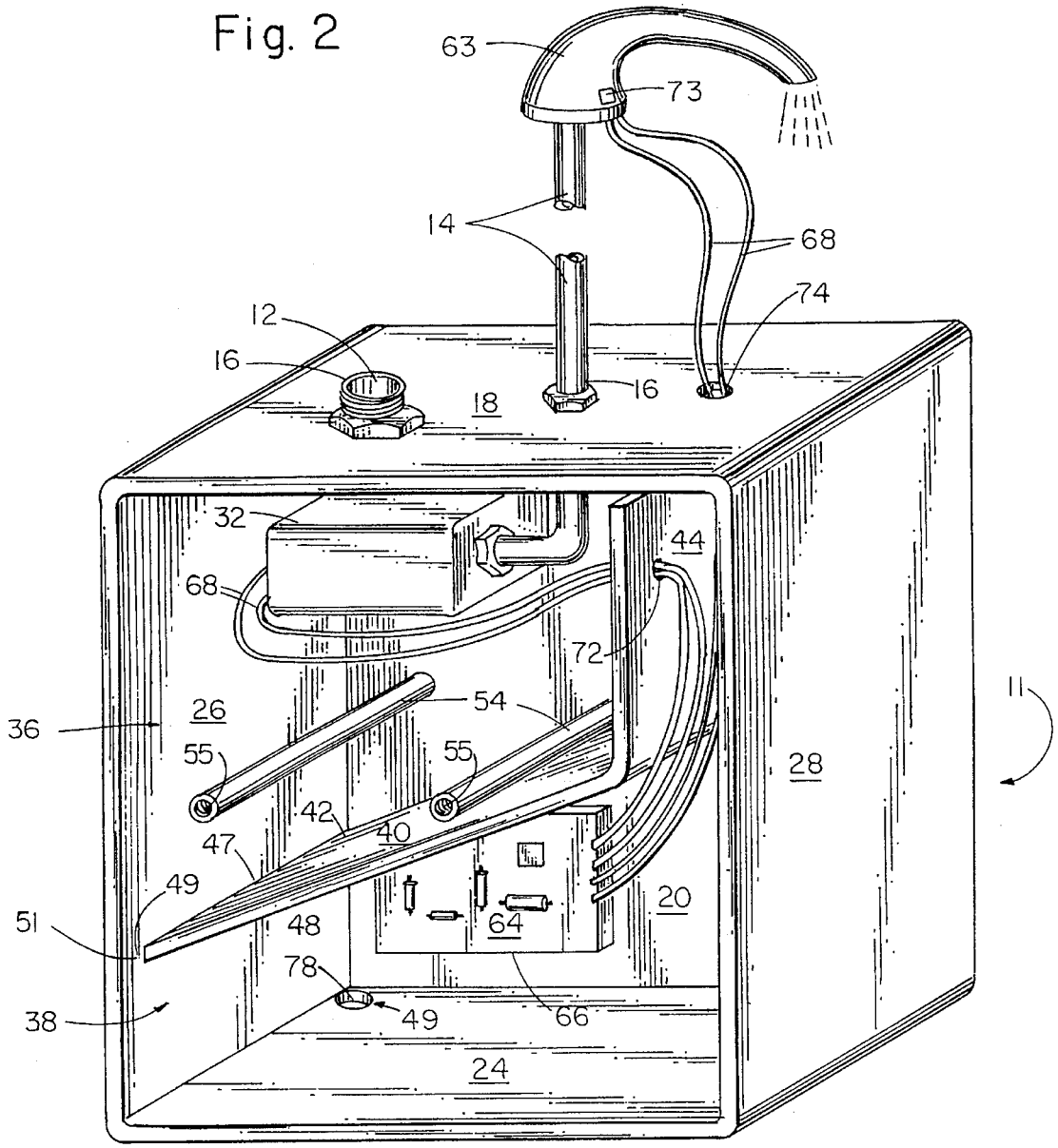
FIG. 2 of the drawing is an elevational view of an alternate embodiment of the enclosure of the invention.
Figure 3:
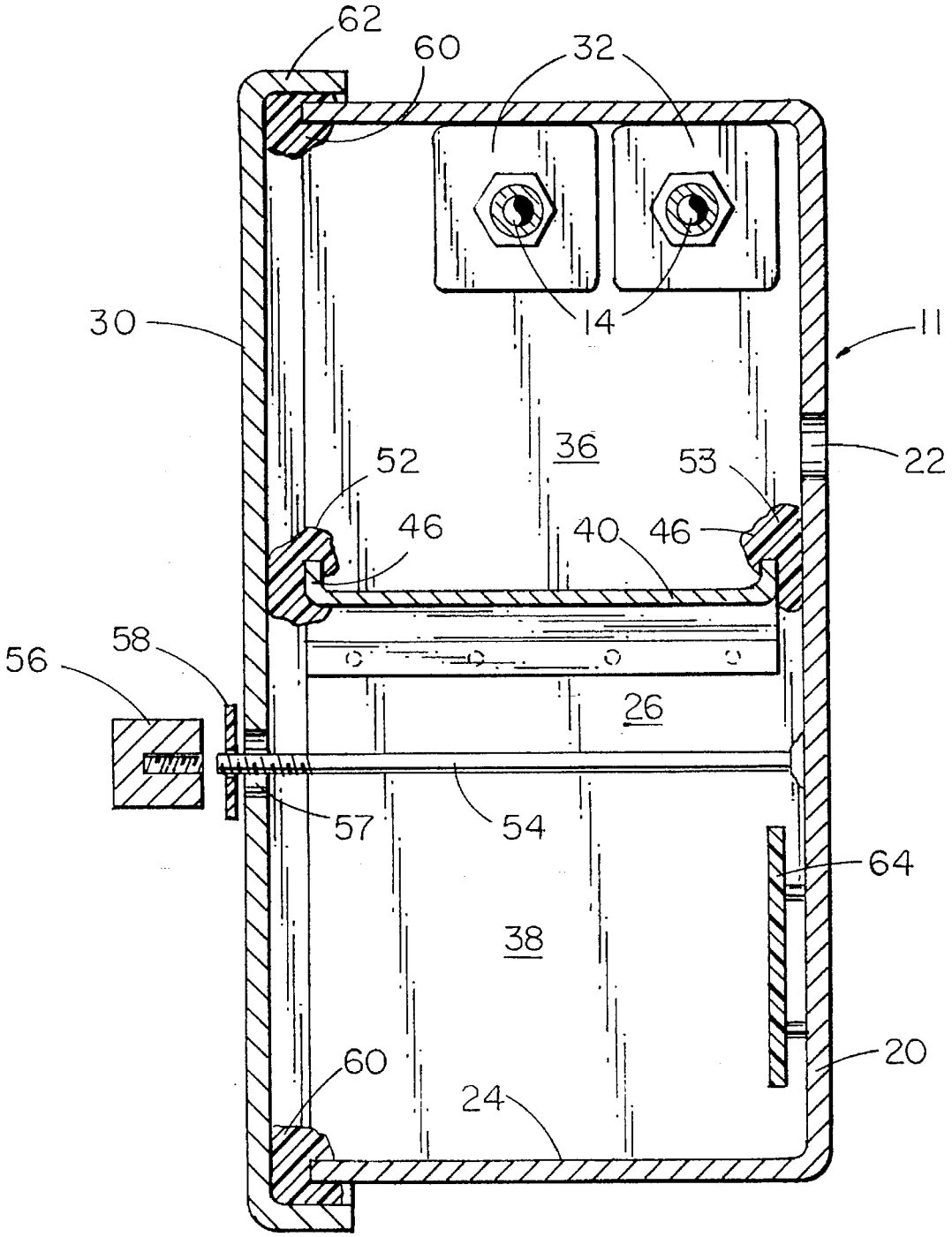
FIG. 3 of the drawing is a cross-sectional view, taken along the line 3—3 of FIG. 1.

The divided box 11 comprises a valve chamber 36 separated from an electronics compartment 38 by an internal dividing wall 40 having a generally horizontal, but slanted, portion 42 that may extend laterally and upward from one side wall 26 of the box 11 (e.g., as shown in FIG. 1) or that may extend outward of the back wall 20 (e.g. as shown in FIGS. 2 and 3). The dividing wall 40 may have a vertical portion 44 extending upwards to a point adjacent the top 18 of the box 11. The divider 40 may also comprise an upturned lip 46 at a free edge thereof 48 distal from the back wall 20. The slanted portion 42 of the divider 40 acts as a gutter carrying water dripping from a valve 32 to a lowest end 47 near a side wall 26 from whence it can be drained from the upper chamber 36 via an appropriately placed throughhole 50 in the sidewall 26 of the box 11 or via a gap 51 intermediate the side wall 26 and a proximate portion of the divider 40. In a preferred embodiment of the invention, the divider 40 has a deformable gasket 52 on its free edge 48, the gasket sealing against the lid 30 when the enclosure 10 is closed. If the box 11 is made with the divider 40 attached to the side wall 26, rather than to the back wall 20, a corresponding lip 46 and sealant bead 53 may be used adjacent the back wall 20.

In a preferred embodiment, the lid 30 is attached to the box 11 by a combination of studs 54 extending outward from the back wall 20 and having a threaded portion distal from the back wall, cooperating threaded fasteners, such as the knurled nuts 56 engaging the threaded fasteners 54 through a hole 57 in the lid 30, and resilient sealing washers 58. This provides an enclosure 10 with a completely sealed lid 30 when the lid 30 is clamped to the box 11 by tightening the nuts 56: a gasket 60 disposed about the edge-lip 62 of the lid 30 seals against the free edges of the four walls 20, 24, 26, 28 of the box 11; the gasket 52 on the divider 40 seals against the inner surface of the lid 30; and the resilient washers 58 prevent leaks around the stud 54. It will be understood to those skilled in the art that other clamping means (e.g., the combination of a screw (not shown) extending through the lid 30 and engaging a female threaded hole 55 in the end of a stud) could equally well be used to provide a sealed enclosure. In many locations in which electrically operated faucets 63 and the like are installed vandalism is a problem, so a preferred clamping means employs known tamper-resistant screw-heads. It is also understood that the various gaskets 52, 60 could be affixed to either the lid 30 or to appropriate portions of the box 11.

A circuit board 64 containing the controller electronics is preferably mounted vertically on the back wall 20 of the box with its bottom edge 66 above the bottom 24 of the box 11. The electrical wires 68 connecting the circuit board 64 to the solenoid valves 32 may pass directly through a potted hole 70 in the slanted divider 40, as shown in FIG. 1 of the drawing. Alternately, the wires 68 may pass from the electronics chamber 38 to valve chamber 36 through a hole 72 adjacent the top 18 of the box 11, or may pass around the dividing wall 40 at a gap 51 adjacent an end thereof. Additional wiring (e.g., from a faucet sensor 73 or an alternating current power supply (not shown)) can also be brought into the electronics compartment 38 via a sealed hole 74 in one of the walls 18, 24, 26, 28 of the box A preferred embodiment of the invention provides drainage means 49 such as the drain hole 50 for conveying water outside the box 11 from the lowest end 47 of the dividing wall 40 in the valve chamber 36, Other configurations for draining water from the box under the influence of gravity are possible. As shown in FIG. 2 of the drawing, one may place a gap 51 adjacent the lowest end 47 of the slanted divider 40. This allows water to drain from the valve chamber 36 into the nominally dry electronics chamber 38. This water then drains from the lower chamber 38 to the outside of the box 11 via a additional drainage means 49 such as a throughhole 78 in the bottom 24 wall of the box 11. This latter approach is sometimes acceptable because of the low volumes of water involved and because the bottom 66 of the circuit board 64 is mounted above the bottom 24 of the box 11 so that small quantities of water in the electronics chamber 38 do not wet the circuit board 64.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is desired to be secured by Letters Patent is:

1. An enclosure for an electrically powered valve controller and an electrically operated valve, the valve and the valve controller connected by electrical wires, the enclosure comprising a box, a lid and a clamping means clamping the lid to the box, the box comprising a vertically oriented back exterior wall, a top exterior wall, a bottom exterior wall, two side exterior walls and an internal dividing wall having at least a pair of ends and attached to one of the exterior walls, the internal dividing wall positioned between two of the exterior walls in a slanted manner, the dividing wall dividing the box into an upper chamber containing the electrically operated valve and a lower chamber containing the electrically powered valve controller, an opening in the dividing wall allowing passage of the wires between the upper and lower chambers, the box further comprising drainage means adjacent a lower end of the slanted dividing wall, the drainage means draining water leaking from the valve into the upper chamber, the drainage means conveying the water from the upper chamber along the slanted dividing wall and through a throughhole in one of the exterior walls to the outside of the box under the influence of gravity, the box further comprising throughholes adjacent the top wall for water inlet and outlet fittings.

2. The enclosure of claim 1 further comprising a resilient sealing means intermediate the box and the lid.

3. The enclosure of claim 1 wherein the dividing wall comprises a vertically oriented portion.

4. The enclosure of claim 1 wherein the drainage means comprises a throughhole in a side wall of the box adjacent the upper chamber thereof.

5. The enclosure of claim 1 wherein the drainage means comprises a throughhole in the bottom of the box.

6. The enclosure of claim 1 wherein the electric wires interconnecting the valve and valve controller pass through a gap intermediate the dividing wall and one of the exterior walls.

* * * * *